United States Patent [19]

Gaiardo

[11] Patent Number: 4,798,484

[45] Date of Patent: Jan. 17, 1989

[54] DOT MATRIX PRINT HEAD

[75] Inventor: Mario Gaiardo, Ivrea, Italy

[73] Assignee: Microlys S.p.A., Turin, Italy

[21] Appl. No.: 69,985

[22] Filed: Jul. 6, 1987

[30] Foreign Application Priority Data

Jul. 25, 1986 [IT] Italy ..... 53690 B/86

[51] Int. Cl.[4] ..... B41J 3/12

[52] U.S. Cl. ..... 400/124; 101/93.05

[58] Field of Search ..... 400/124; 101/93.05; 335/275, 276

[56] References Cited

U.S. PATENT DOCUMENTS

| | | | |
|---|---|---|---|
| 4,051,941 | 10/1977 | Hebert | 400/124 |
| 4,244,658 | 1/1981 | Mori | 400/124 |
| 4,375,338 | 3/1983 | Mitsuishi | 400/124 |
| 4,518,269 | 5/1985 | Akazawa | 400/124 |
| 4,548,522 | 10/1985 | Harada | 400/124 |
| 4,569,605 | 2/1986 | Meier | 400/124 |
| 4,600,321 | 7/1986 | Kwan | 400/124 |

*Primary Examiner*—Paul T. Sewell

*Attorney, Agent, or Firm*—Omri M. Behr

[57] ABSTRACT

A dot matrix print head is described having an improved type of electromagnetic actuator device for the print needles; the ends of the striker elements which cooperate with one of the poles of the electromagnetic drive for each needle are in fact shaped on the side facing the said pole, in such a way as to be displaced with respect to the point of contact of the striker element on the pole itself, so as to cause between this end and the pole a predetermined clearance capable of compensating possible constructional imprecisions. (FIG. 2).

5 Claims, 2 Drawing Sheets

DOT MATRIX PRINT HEAD

BACKGROUND OF THE INVENTION

The present invention relates to a dot matrix print head provided with an electromagnetic device for actuating the print needles which is improved in its mechanical part.

It is known that in dot matrix print heads the needles are projected against the surface to be printed, in such a way as to leave on this symbols which form the print characters, by means of an electromagnetic device comprising, for each needle, a U-shape electromagnet and a striker element, the said blade, which rockably engages with its first end on the corner of one of the poles of the electromagnet, and is attracted by the other pole when the electromagnet is excited, in such a way as to strike with its second end the head of the associated print needle. Such a structure involves the fact that, when the electromagnet is not excited, the first end of the blade, under the thrust of appropriate resilient biasing means, usually constituted by a rubber ring, abuts against the associated pole so that this must be worked with high precision in that it is necessary to avoid, in this rest position of the blade, any possible interference between this and the pole on the corner of which it engages; if, in fact, interference should occur, the position of the blade would be altered and, consequently, the quality of printing would be drastically reduced.

SUMMARY OF THE INVENTION

The object of the invention is that of providing a dot matrix print head of substantially similar structure to that described above, but which avoids the indicated disadvantage and, in particular, which does not require an accurate working of the pole of the electromagnet on which each blade rests, ensuring at the same time an optimum print quality.

The said object is achieved by the invention in that it provides a dot matrix print head of the type comprising an elongate support body slidably carrying a plurality of print needles; respective electromagnets for actuating the said print needles, each having a first and a second adjacent pole of opposite sign; a plurality of striker elements made of ferromagnetic material each of which can be attracted by the first pole of an associated said electromagnet to strike with its first end the head of a respective said needle in such a way as to cause translation thereof, the said striker elements being rockably engaged in correspondence with an intermediate portion thereof on one edge of a front delimitation surface of the second poles of the said electromagnets; and means for resiliently supporting a second end of each said striker element, opposite the first end, in correspondence with the second poles of the said electromagnets; characterised by the fact that the said second ends of the striker elements are shaped on the side facing the corresponding second pole, in such a way as to be displaced, with respect to the contact point of the said intermediate portion thereof on the said edge of the said corresponding second pole of the electromagnets, in such a way as to determine a clearance between the front surfaces of the second poles of the electromagnets and the said second ends of the striker elements.

BRIEF DESCRIPTION OF THE DRAWINGS

For a better understanding of the invention there is now given a non-limitative description of several embodiments with reference to the attached drawings, in which.

DETAILED DESCRIPTION OF THE INVENTION

Figure 1:
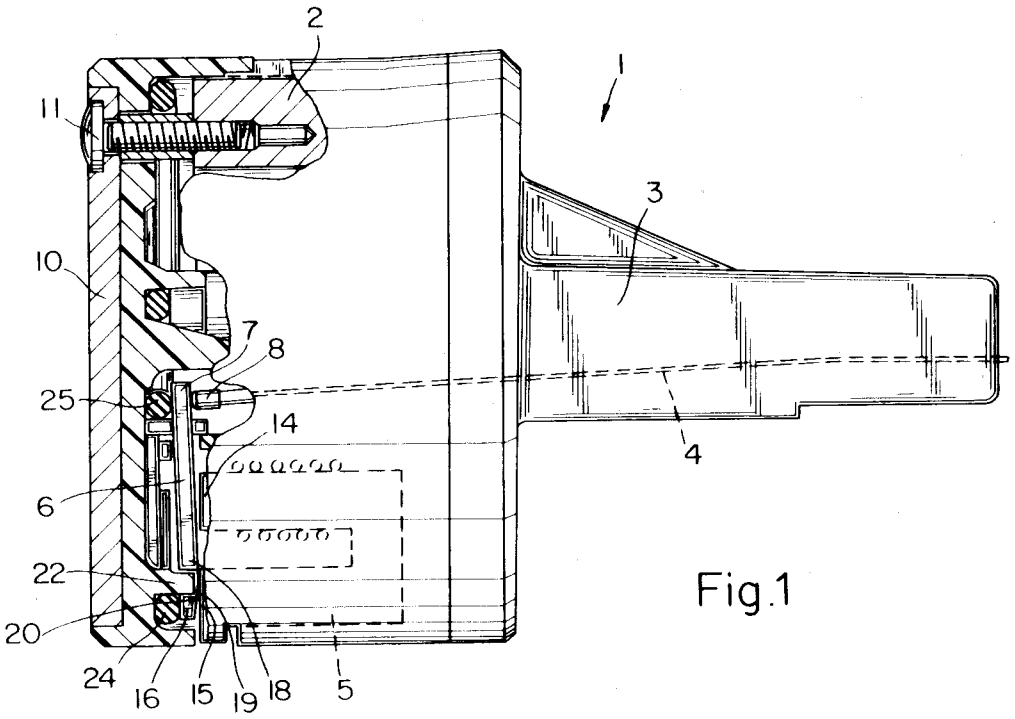
FIG. 1 illustrates in side view and partly in section a print head formed according to the invention.

With reference to FIG. 1 there is shown therein a dot matrix print head generally indicated with the reference numeral 1 comprising a casing 2 closed at the front by an elongate support body 3 slidably carrying a plurality of print needles 4 only one of which is illustrated for simplicity, respective electromagnets 5 for actuating the needles 4, of known U-shape type and housed in a known manner within the casing 2, and a plurality of striker elements or blades 6 equal in number to those of the electromagnets 5 and the needles 4, made of ferromagnetic material and able to be attracted by the respective electromagnets 5 to strike with their respective ends 7 against respective heads 8 of the needles 4 in such a way as to cause translation of these latter and consequent impact thereof onto the surface to be printed. The striker elements or blades 6, only one of which is illustrated for simplicity, are disposed in a known manner in a ring and are carried in the manner of spokes by a circular plug or cover 10 of known type which closes the casing 2 at the rear and which is fixed rigidly to this latter and, consequently, to the body or support element 3 for the needles 4 by known connection means 11. Each electromagnet 5 has a pair of opposite poles of opposed sign, respectively indicated 14 and 15 disposed adjacent one another; the electromagnets 5 are also disposed in a radial configuration within the casing 2 in such a way that the poles 14 are disposed closer to the axis of symmetry of the print head 1 than the poles 15, or rather are radially inward of these latter.

Figure 2:
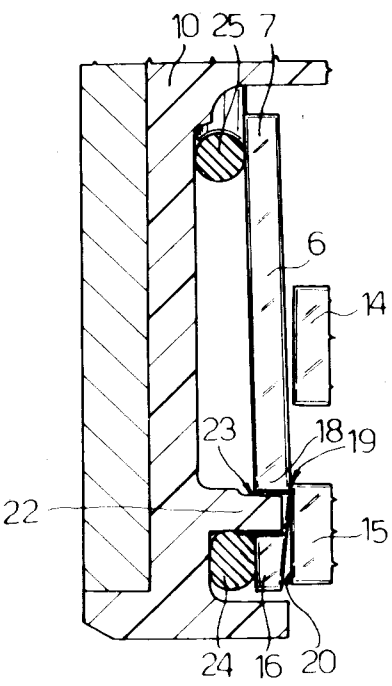
FIG. 2 illustrates on an enlarged scale a detail of the print head of FIG. 1.

Referring also to FIG. 2, the striker elements or blades 6 have a second end 16 opposite the end 7, by which they are supported rockably in a resilient manner in correspondence with the respective pole 15 of each electromagnet 7 by means carried by the plug 10, and an intermediate portion 18, immediately adjacent the end 16, in correspondence with which they are rockably engaged, or rather free to oscillate perpendicularly to the plane in which the plug 10 lies, on a fulcrum constituted by an edge 19 of a flat front delimitation surface 20 of the respective pole 15; the said resilient support means of the end 16 comprises a respective pin 22 one for each element 6, formed integrally with and perpendicularly projecting from the plug 10 on the inner side thereof and housed with clearance within the interior of a hole 23 formed through the end 16 immediately adjacent the intermediate portion 18, and a resilient biasing element common to all the elements 6 constituted by a natural or synthetic rubber toroidal seal 24 of 'O-ring' type disposed immediately behind the end 16 between this and the bottom wall of the plug 10 in such a way as to oppose separation of the end 16 itself from the pole 15 following rotation of the element 6 on the corner 19 towards the pole 14. On the end 7 of each element 6 also acts a further resilient biasing element constituted by a seal 25 of the same type as the seal 24, carried in a known way by the plug 10.

According to the invention the end 16 of each striker element or blade 6 is shaped, on the side facing the corresponding pole 15, in such a way as to be displaced, with respect to the point of contact of the respective intermediate portion 18 on the edge 19, so as to determine between the frontal surfaces 20 of the poles 15 and the ends 16 of the striker elements 6 an axial clearance of predetermined magnitude which is always such that, in normal operating conditions of the head 1, any possible interference between the poles 15 and the ends 16 is avoided in rest condition of the blades 6, which is that illustrated in FIG. 2 and assumed under the resilient thrust of the element 24 when the electromagnets 5 are de-energised. In the non-limitative embodiment illustrated in FIG. 2 the ends 16 of the striker element 6 are all bent at an obtuse angle out of the plane in which the elements 6 themselves lie, which is substantially parallel to that of the cover 10, on the side of the elastomeric biasing element 6 in such a way as to space them from the respective facing surfaces 20. In this way, in the illustrated rest position, between the portion 18 and the corner 19 of each blade 6 there is a substantially linear contact between sharp corners, which reduces the friction, improving the performance of the head whilst there is no possibility of contact between the surface 20 and the end 16 which is spaced from the portion 18. In use, therefore, when the electromagnets 5 are excited they attract the blades 6 towards the respective poles 14 making them turn on the edges 19 of the poles 15 with which they already cooperate, causing the ends 17 to strike on the heads 8 and consequent actuation of the needles 4, whilst when the electromagnets 5 are de-energised the blades 6 are moved under the resilient thrust of the seals 24 and 25 into the rest position illustrated in FIG. 2, avoiding any interference with the poles 15 which, consequently, do not require accurate working; possible dimensional errors are compensated, the contact between the blades 6 and the poles 15 being only linear, by the resilient suspension system of these through the pins 22, so that again working tolerances of the electromagnets 5, and in particular of the poles 15, can be rather large with consequent considerable reductions in production costs.

Figure 4:
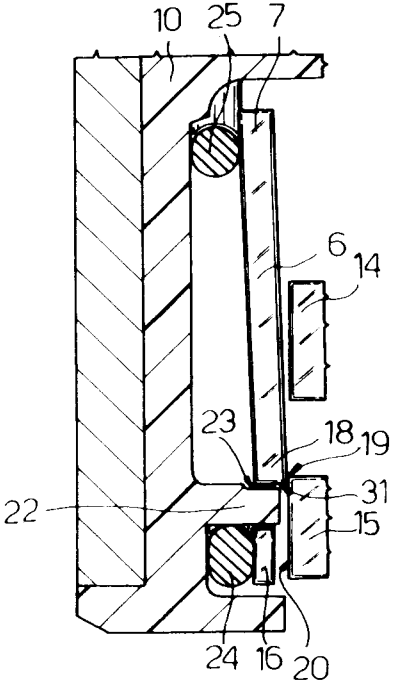
FIGS. 3 and 4 respectively illustrate a first and a second possible variant of the detail of FIG. 2.
Figure 3:
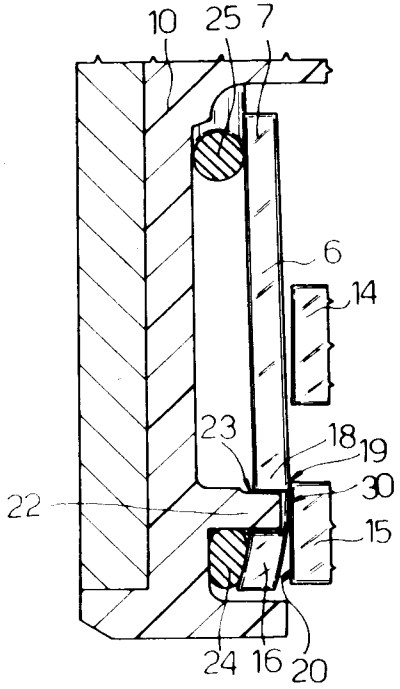

Making reference now to FIGS. 3 and 4, in these there are shown two possible variations to the conformation of the ends 16 of the blades 6 which are equally useful or more useful than that described; the similar or identical details to those already described are indicated for simplicity with the same reference numerals. In particular, in FIG. 3 is illustrated a blade or striker element 6 substantially identical to the blade 6 of Figure 2 save for the fact that the end 16 is bent with respect to the axis of the element 6 itself with a wide radius of curvature in such a way that in correspondence with the portion 18 the elements 6 all have a convexly curved contact surface 30 at the corner 19, obviously facing towards the pole 15; with this variant, of slightly greater cost than if the blade is simply bent at an angle as in FIG. 2, greater usefulness is achieved in that the curved surface 30 further reduces the friction and above all reduces wear of the corner or edge 19 as well as of the portion 18, guaranteeing a longer life and greater reliability of the needle drive device. The variant of FIG. 4 illustrates on the other hand a blade 6 which achieves substantially the same utility as that of FIG. 2 whilst having a reduced cost; in this variant the striker elements have a step 31 in correspondence with the ends 16, formed substantially at the edge of the associated hole 23 for housing the respective pin 22, and the ends 16 have a smaller thickness than that of the corresponding intermediate portions 18; the desired clearance between the end 16 and the surfaces 20 is thus created.

From what is described the advantages connected with the invention will be evident and it is clear that the three described variants of the blade, together with other possible variants which still fall within the scope of the invention can also be combined, even in the same head, if such should be useful.

I claim:

1. A dot matrix print head comprising:

an elongated support body slidably carrying a plurality of print needles;

a cover for said support body rigidly connected thereto;

respective drive electromagnets for actuating said print needles, the electromagnets being disposed in a circular configuration and each having a first and a second pole of opposite sign adjacent to each other;

a plurality of striker elements disposed in a ring and made of ferromagnetic material, each able to be attracted by the first pole of a respective one of said electromagnets to strike with its first end the head of an associated said needle in such a way as to produce translation thereof; and support means for resiliently supporting a second end of said striker elements, opposite the first end; wherein, in combination:

(i) each of said striker elements having an intermediate portion corresponding with and operating as a fulcrum upon a fulcrum edge of a flat front delimitation surface of the second poles of the said electromagnets;

(ii) said electromagnets being disposed with their said first poles positioned radially inward of their second poles;

(iii) said support means for the second end of each of said striker element comprising:

a pin formed integrally with and perpendicularly projecting from said cover, said pin being positioned with clearance within the interior of a hole formed through said second end of each striker element, immediately adjacent said intermediate portion thereof; and a biasing element disposed between said second end of each striker element and said cover, in such a way as to oppose separation of said second end from the associated second pole of the respective electromagnet;

(iv) said second end of each of said striker elements is shaped on the side facing the corresponding second pole of the associated said electromagnet in such a manner as to be displaced, with respect to the associated said fulcrum so as to determine between it and the frontal flat surface of the associated said second pole an axial clearance, each striker element between its second end and its fulcrum at said fulcrum edge being shaped to engage said biasing element and maintain clearance over said second pole.

2. A print head according to claim 1, characterised by the fact that the said biasing element being elastomeric and the said pin and elastomeric element being carried by the cover rigidly connected to the said needle support element.

3. A print head according to claim 2, characterised by the fact that the said striker elements have respective second ends bent at an obtuse angle out of the plane in which they lie towards the elastomeric biasing element.

4. A print head according to claim 3, characterized by the fact that the said second ends are bent with respect to the axis of the associated striker elements the intermediate portion of said striker elements presenting a curved surface, convex toward the associated said edge of the second pole of the associated said electromagnet, and contacting therewith.

5. A print head according to claim 2, characterised by the fact that the said striker elements have, in correspondence with respective second ends, a step formed substantially at the edge of the respective said hole housing the said pin, the said second ends having a smaller thickness than that of the corresponding intermediate portions

* * * * *